US010928777B2

(12) United States Patent
Gerber et al.

(10) Patent No.: US 10,928,777 B2
(45) Date of Patent: Feb. 23, 2021

(54) WATCH MOVEMENT COMPRISING A RETROGRADE DISPLAY AND A JUMP HOUR RING

(71) Applicant: Chanel Sarl, Geneva (CH)

(72) Inventors: Yves Gerber, Cernier (CH); Sébastien Mojon, La Chaux-de-Fonds (CH); Guilhem Watrelot, Villers-le-Lac (FR)

(73) Assignee: Chanel Sarl, Geneva (CH)

( * ) Notice: Subject to any disclaimer, the term of this patent is extended or adjusted under 35 U.S.C. 154(b) by 362 days.

(21) Appl. No.: 16/085,175

(22) PCT Filed: Mar. 15, 2017

(86) PCT No.: PCT/IB2017/051498
§ 371 (c)(1),
(2) Date: Sep. 14, 2018

(87) PCT Pub. No.: WO2017/158527
PCT Pub. Date: Sep. 21, 2017

(65) Prior Publication Data

US 2019/0086867 A1 Mar. 21, 2019

(30) Foreign Application Priority Data

Mar. 15, 2016 (CH) ..... 0348/16

(51) Int. Cl.
*G04B 19/02* (2006.01)
*G04B 19/08* (2006.01)
(Continued)

(52) U.S. Cl.
CPC ..... *G04B 19/02* (2013.01); *G04B 19/082* (2013.01); *G04B 19/202* (2013.01); *G04B 27/004* (2013.01)

(58) Field of Classification Search
CPC .... G04B 19/02; G04B 19/082; G04B 27/004; G04B 19/202; G04G 9/02; H04W 4/025; G06F 16/20
See application file for complete search history.

(56) References Cited

U.S. PATENT DOCUMENTS 5,784,342 A 7/1998 Genta
5,943,299 A * 8/1999 Genta ..... G04B 19/241 368/28

(Continued)

FOREIGN PATENT DOCUMENTS

CH 691833 A5 10/2001
CN 203069969 U 7/2013

(Continued)

OTHER PUBLICATIONS

International Search Report for PCT/IB2017/051498 dated Jul. 6, 2017, 2 pages.

(Continued)

*Primary Examiner* — Sean Kayes
(74) *Attorney, Agent, or Firm* — Blank Rome LLP

(57) ABSTRACT

A watch movement comprising a retrograde mobile, an hours ring bearing an asymmetric internal toothing and driven by the retrograde mobile in order to display the current hour in a jumping way, a correction mechanism allowing the retrograde mobile to be corrected in both directions, a drive member that can be actuated by said correction mechanism and engages with said asymmetric internal toothing so that corrections of the retrograde mobile in the clockwise direction are transmitted to the hours ring, whereas corrections in the counterclockwise direction are not transmitted to the hours ring.

16 Claims, 21 Drawing Sheets

(51) Int. Cl.
*G04B 27/00* (2006.01)
*G04B 19/20* (2006.01)

(56) References Cited

U.S. PATENT DOCUMENTS

| | | | | |
|---|---|---|---|---|
| 7,969,824 | B2 * | 6/2011 | Wiederrecht | G04B 19/207<br>368/220 |
| 8,004,936 | B2 * | 8/2011 | Ruchonnet | G04B 19/247<br>368/77 |
| 9,239,570 | B2 * | 1/2016 | Graemiger | G04B 19/02 |
| 10,222,749 | B2 * | 3/2019 | Denden | G04B 19/044 |

FOREIGN PATENT DOCUMENTS

| | | | |
|---|---|---|---|
| EP | 0788036 | A2 | 8/1997 |
| EP | 1868048 | A1 | 12/2007 |

OTHER PUBLICATIONS

International Written Opinion for PCT/IB2017/051498 dated Sep. 21, 2017, 6 pages.

* cited by examiner

WATCH MOVEMENT COMPRISING A RETROGRADE DISPLAY AND A JUMP HOUR RING

RELATED APPLICATIONS

This application is a national phase of PCT/IB2017/051498, filed on Mar. 15, 2017, which claims the benefit of Swiss Application No. 00348/16, filed on Mar. 15, 2016. The entire contents of these applications are hereby incorporated by reference.

TECHNICAL FIELD

The present invention relates to a correction mechanism for a watch movement with retrograde and jumping display.

PRIOR ART

Retrograde displays, namely displays in which a hand or a disk rotates in one direction over a given period and then snaps back almost instantaneously to the initial position by rotating quickly in the opposite direction at the end of this period, are known in horology. These retrograde displays are used, for example, to indicate minutes over a graduation from 1 to 60 covering a circular arc of under 360°. These retrograde displays make it possible to free up space on the dial for indicating other information. Furthermore, the rapid return of the minutes indicator every hour creates movement on the watch face.

Jumping displays, in which a time indicator jumps almost instantaneously from one value to another, are also known. These jumping displays are notably used for displaying the date in a window. They are sometimes used to indicate other information, including indicating the current hour in a window. Within the present application, the expression "jumping display" covers both displays in which the jump is near instantaneous and displays referred to as trailing displays in which this jump is not as rapid, although the moving-on of the display is nevertheless discontinuous.

Watches that combine a retrograde display and a jumping display are also known.

CH691833 describes one example of a watch comprising a jumping hours display and a retrograde minutes display. A minutes rack has two toothed parts, one for transmitting the movement to the minutes display member and the other to be driven by a pinion with one missing tooth, this pinion being fixed to the hours wheel and driven at the rate of one revolution per hour. The instantaneous return of the rack corresponds to the movement of the last tooth of the rack at the site of the missing tooth of the pinion. This correction device exhibits the major disadvantage of increasing the bulk of the movement and of being complex.

EP0788036B1 relates to a watch with a retrograde minutes display and a jumping hours display on a disk. A lever is progressively lifted once per hour by the rotation of a snail cam secured to the minutes wheel.

It is an object of the present invention to create a simple correction mechanism for a watch movement, combining both a retrograde display and a jumping display.

BRIEF SUMMARY OF THE INVENTION

It is an object of the present invention to propose a time correction mechanism for a watch movement with retrograde and jumping display, which is free of the limitations of the known time-setting mechanisms.

Another object is to propose a correction mechanism which allows more rapid and less restrictive correction of the current time.

According to the invention, these objects are notably achieved by means of a movement and of a method according to the features of the corresponding typical claims.

According to the invention, the watch movement comprises:

- a retrograde mobile;
- an hours ring bearing an asymmetric internal toothing and driven via the retrograde mobile in order to display the current hour in a jumping way;
- a correction mechanism allowing the retrograde mobile to be corrected in a bidirectional way;
- a drive member that can be activated by the correction mechanism and engages with the asymmetric internal toothing so that corrections of the retrograde mobile in the clockwise direction are transmitted to the hours ring, whereas corrections in the counterclockwise direction are not transmitted to the hours ring.

By virtue of the two-directional correction of the retrograde display, it is possible to correct its position without completing a full revolution. The time can thus be set more quickly.

For example, in the case of a retrograde minutes display, it is possible to correct the position of this indicator in both directions. If the watch movement gains by a few minutes, it can therefore be corrected back without having to make an almost full revolution forwards and without affecting the position of the hours indicator.

This solution thus offers the advantage over the prior art of allowing a simple and quick correction of the retrograde indicator, for example the minutes indicator.

The corrections of the retrograde indicator in the clockwise direction are transmitted to the jumping hours ring. In the case of a retrograde minutes indicator, this for example makes it possible to correct the jumping hours indicator in the clockwise direction, with a jump by one hour each time the minutes indicator moves on from 59 to 00. This correction of the jumping hours ring can be achieved very simply by using the jumping hour drive mechanism used during normal watch operation.

The corrections of the retrograde minutes indicator in the counterclockwise direction (in order to retard it) are, by contrast, preferably not transmitted to the jumping hours ring. This is because the usual jumping hours drive mechanisms do not usually allow a jump to be made in the counterclockwise direction; they are designed only to move the jumping hours ring on in the clockwise direction, under the action of the geartrain. In other words, the correction is not driven by the crown in the counterclockwise direction. For example, jumping hours drive mechanisms often comprise a cam with a jump, for example a snail cam, with a jump that can be crossed only in one direction. By avoiding transmitting the corrections in the counterclockwise direction to the jumping hours ring, the need to modify the drive mechanism of this ring is thus avoided.

By thus choosing a correction that is unlimited in the clockwise direction, but limited in terms of correcting the minutes in the counterclockwise direction, a movement is obtained that is practical, easy to manipulate, and at the same time considerably simplifies construction in relation to a movement that allows correction that is unlimited in both directions which affords merely a small improvement in convenience for a considerably greater complexity.

This construction thus makes it possible to produce a correction mechanism that is simple, allowing a great many corrections to be made with very few manipulations of the crown and without needing to modify the jumping hours ring drive mechanism.

In one embodiment, a correction blocking mechanism is provided to prevent the retrograde mobile from being corrected in the counterclockwise direction within a range around the jump of this mobile, and to allow same in all the other positions of this mobile outside of that range. For example, if the retrograde mobile displays minutes, the mechanism may prevent correction in the counterclockwise direction when the retrograde minutes indicator is indicating a value in a range including the minute 60. That makes it possible to avoid the risk of the jumping hours indicator accidentally moving on as a result of a correction in the counterclockwise direction to the minutes mobile in this range.

This correction blocking mechanism may be connected to the cam feeler, which may be on the rack, and block the rotation of a snail cam in one of the two directions of rotation when this snail cam is situated near to the position of the feeler jump.

In the movement according to the invention, the asymmetric internal toothing may comprise a plurality of teeth with asymmetric flanks, the drive member being arranged in such a way as to be able to butt against one flank of a tooth of the internal toothing and to be able to drive the hours ring when the retrograde mobile is rotating in one direction, and to be able to slide along another flank of a tooth of the internal toothing when the retrograde mobile is rotating in the opposite direction.

In one embodiment, the retrograde mobile may display the minutes.

The movement may comprise a snail cam and a feeler engaging with the snail cam in order to act on the rack to drive the retrograde mobile.

The feeler and the rack may be incorporated into a single component or may be made up of two separate components.

The movement according to the invention may comprise a spring mounted on the rack and able to apply a return force to the drive member in order to press it against the internal toothing of the hours ring.

In the movement according to the invention, the snail cam rotating in a first direction of rotation may drive the rack and the retrograde mobile in the opposite direction of rotation to the first direction.

The movement according to the invention is designed to allow unlimited correction of the hours and minutes display in the clockwise direction.

The movement according to the invention may be designed to allow correction of the hours in the clockwise direction, in a jumping way.

The movement according to the invention may be designed to allow correction of the minutes display in the counterclockwise direction.

The movement according to the invention may be designed to allow correction of the minutes display in the counterclockwise direction only when the minutes indicator is in a first range, and to prevent any correction of the minutes display in the counterclockwise direction when the minutes indicator is in a second range.

The movement according to the invention may comprise a correction blocking mechanism to prevent the minutes from being corrected in the counterclockwise direction within a range that includes the instant at which the retrograde mobile returns, and to allow the minutes to be corrected in the counterclockwise direction outside of that range.

That makes it possible to avoid the risk of the jumping hours indicator accidentally moving on as a result of a correction of the retrograde mobile close to the instant at which the mobile returns.

According to the invention, the method for correcting the display of an item of time-based information on a watch movement may comprise the following steps:

in a first interval, for example in an interval from 0 to 59 minutes:

- the rotation of a time-setting stem in a first direction causes a snail cam to rotate in a first direction, and a rack to rotate in a second direction,
- the rotation of the rack in the second direction causes the retrograde mobile and the drive member to rotate, and
- the drive member moves along a first flank of an internal toothing of a ring without driving the rotation of the ring, then, at minute 60:

- the rotation of the snail cam causes the rack to fall and to rotate in the first direction near-instantaneously;
- the near-instantaneous rotation of the rack in the first direction drives the near-instantaneous rotation of the retrograde mobile
- the rotation of the drive member pressing against a second flank of the internal toothing of the ring drives this ring with jumping.

This solution offers the advantage of a correction of the minutes in the range 0 to 59 min which does not interfere with the hours disk and can therefore be performed in both directions.

Preferably, the rotation of the drive member pressing against a second flank of the internal toothing of the ring drives this ring near-instantaneously.

The correction method according to the invention may exhibit steps in which:

- the rotation of the time-setting stem in a second direction causes the snail cam to rotate in the clockwise direction;
- the rotation of the snail cam in the clockwise direction causes the rack to rotate in the counterclockwise direction,
- the rotation of the rack in the counterclockwise direction causes the retrograde mobile and the drive member to rotate in the counterclockwise direction.

This solution offers the advantage of allowing the retrograde minutes and the jumping hours to be adjusted with the time-setting stem in the same correction position.

This solution offers the advantage that the minutes can be adjusted in both directions, clockwise and counterclockwise.

In the correction method according to the invention, the correction of the minutes display in the counterclockwise direction may be limited to the 0-59 minutes interval.

BRIEF DESCRIPTION OF THE FIGURES

Exemplary embodiments of the invention are indicated in the description which is illustrated by the attached figures in which:

FIG. 13 illustrates a view from above of the device according to the invention at minute 0.

EXAMPLE(S) OF EMBODIMENT(S) OF THE INVENTION

Figure 1:
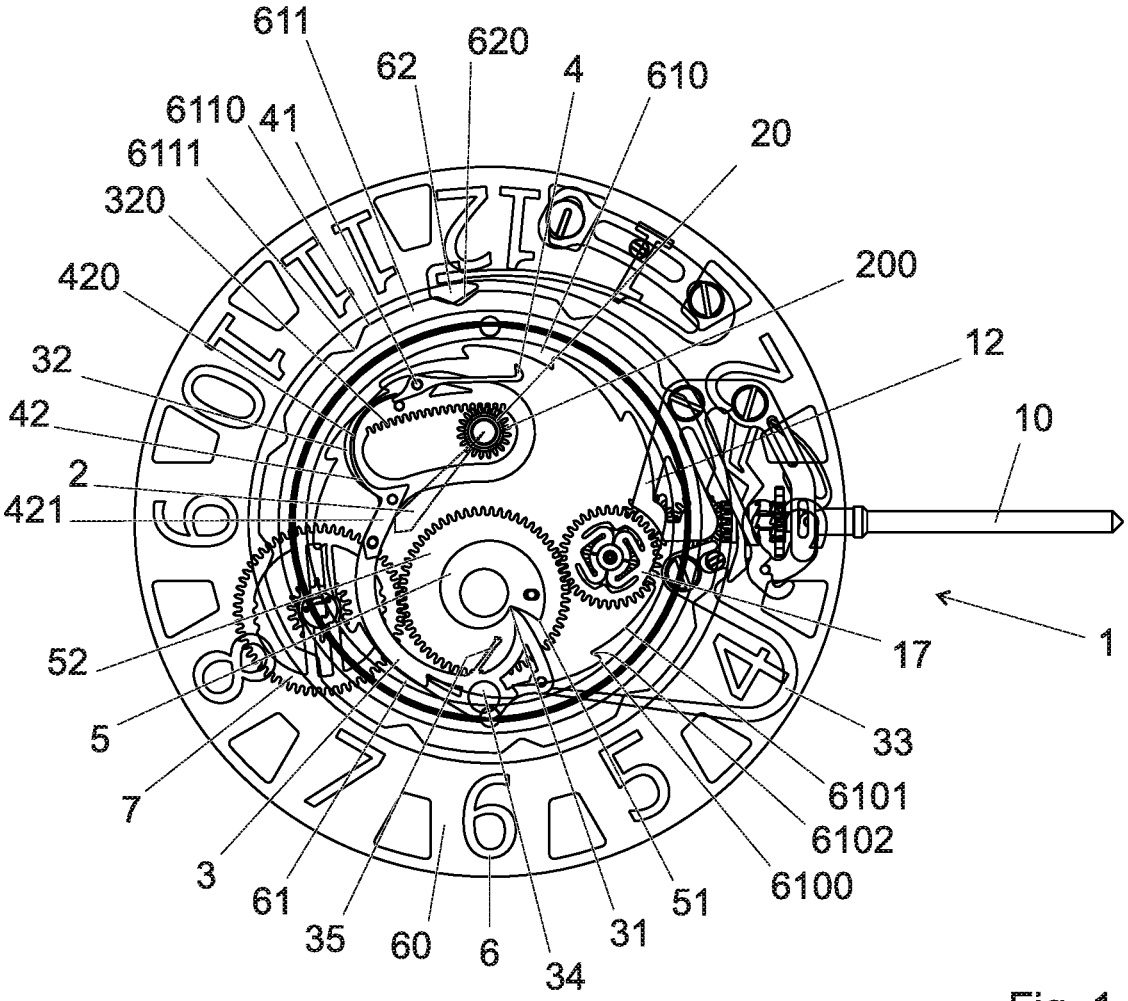
FIG. 1 illustrates a view from above of the key components of the watch movement correction mechanism according to a first embodiment of the invention.

FIG. 1 illustrates the key components of the correction mechanism 1 (also referred to as a time-setting mechanism) of a watch movement according to the invention. This movement comprises a retrograde minutes indicator 2, for example a minute hand or a minutes ring, mounted on the axis of the retrograde minutes mobile 20. The hours are displayed with a jump in a window 8 (FIG. 4) by means of a jumping hours ring 60. The jumping hours ring 60 is immobile throughout almost the entire duration of each hour, then moves on near-instantaneously or slidingly, to the next hour.

The first end 31 of a rack 3 follows the rotation of a snail cam 5 borne by a driving release wheel 52. This driving release wheel 52 is driven by the wheel 7 of the geartrain in such a way that the minutes indicator 2 travels over the minutes scale 9 (FIGS. 4 to 13) in 60 minutes (or 60 minutes minus the return time).

Figure 2:
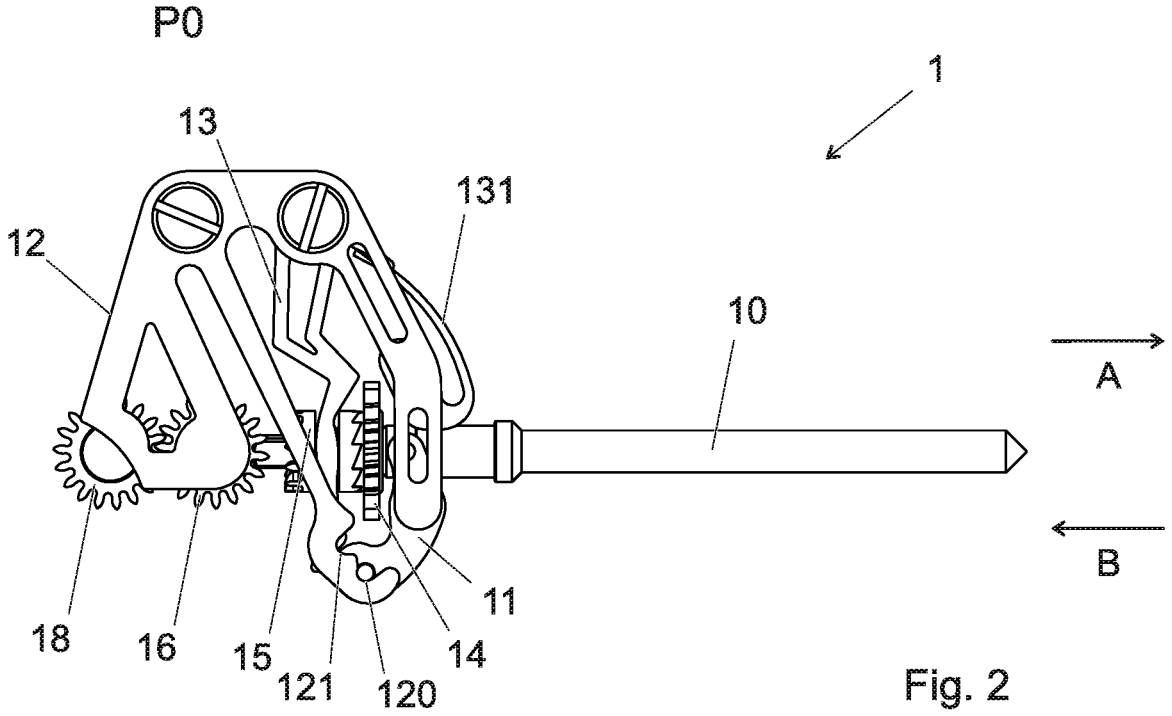
FIG. 2 illustrates a view from above of the rewinding and time-setting stem with the sliding pinion and lever according to the invention, in the rewinding position.
Figure 3:
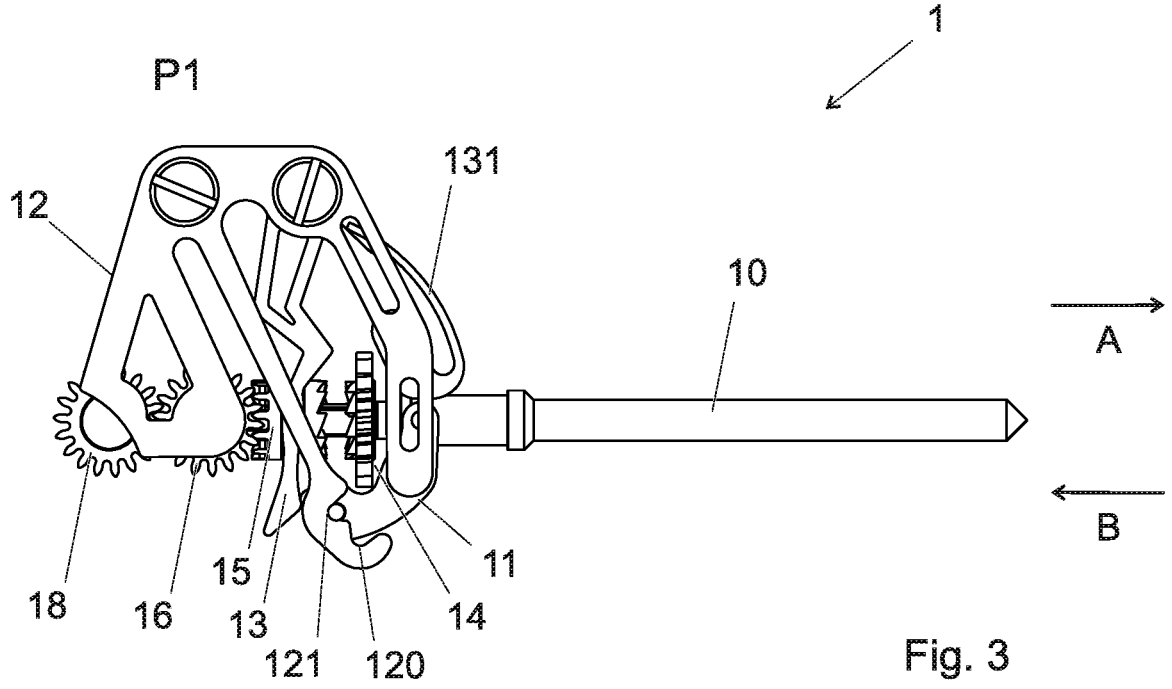
FIG. 3 illustrates a view from above of the rewinding and time-setting stem with the sliding pinion and lever according to the invention, in the correction position.

The correction mechanism is illustrated in FIGS. 2 and 3 in two different positions: "P0" and "P1", of the rewinding and correction stem 10. The time-setting stem 10 allows a sliding pinion 15 to be moved between the positions "P0" and "P1".

In position "P0" illustrated in FIG. 2, referred to as the rewinding position, the sliding pinion 15 engages with the rewinding pinion 14. In position "P1" in FIG. 3, referred to as the correction position, the sliding pinion 15 engages with the correction transfer gear 16. The movement of the sliding pinion between these two positions is afforded by a lever 13, itself driven by a pull-out piece 11 and a pull-out-piece jumper 12.

When the time-setting stem 10 is brought by the user into the position "P1" in the direction of the arrow A, the pull-out piece 11 is held in the indentation 121 of the pull-out-piece jumper 12, while at the same time driving the lever 13 and the sliding pinion 15 in the direction of the arrow B so that the sliding pinion 15 engages with the first correction transfer gear 16.

The first correction transfer gear 16 in its turn engages with the second correction transfer gear 18. With reference to FIG. 1, the second correction transfer gear 18 (FIGS. 2 and 3) is hidden by the pull-out-piece jumper 12 and engages with the minutes geartrain drive wheel 17 which in its turn engages with the release driving gear 52 connected coaxially to a snail cam 5. The wheel 17 is provided with a friction lining to prevent the snail cam 5 from rotating in the clockwise direction when the rack is pressing against the fall of the snail cam, at minute 0. It is therefore not possible to force the minutes indicator to return instantaneously from minute 1 to minute 59.

As illustrated in FIG. 1, the rack 3 has a first end 31 which forms a feeler to follow the periphery of the snail cam 5. The rack and the feeler may also be constructed as several distinct elements. A rack spring 33 presses the rack against the snail cam 5.

The second end 32 of the rack 3 comprises an oblong opening equipped with an internal toothing 320. The rack 3 pivots about a pivot point 34 under the action of the snail cam. During this pivoting, the internal toothing 320 of the second end of the rack 32 engages with the external toothing 200 of the retrograde mobile 20 so that the retrograde indicator 2 borne by the retrograde mobile 20 turns in the same direction as the second end of the rack 32.

A rack end-stop 35, the purpose of which will be detailed later on, is connected to the rack 3 and makes it possible to prevent the snail cam 5 from rotating in the clockwise direction, at least in a blocking range when the feeler 31 is close to the jump of the cam.

The movement of the rack is transmitted to a drive member, here consisting of a tooth 4 articulated to the second end of the rack 32 by means of the axis 41. A return spring 42 applies a return force to the tooth 4 in order to press it against the toothing 610.

Hours indications 6 are borne by the hours ring 60. This ring is mounted on the smaller-diameter drive ring 61. In an alternative form which has not been illustrated, it is also conceivable for the hours indications 6 to be positioned directly on the drive ring 61 or on a ring of the same diameter.

The drive ring 61 comprises an internal toothing 610 with a plurality of teeth around the entire internal periphery. The spacing between the teeth is an even spacing. The teeth have two asymmetric flanks 6100 and 6101. The first flank 6100 is almost radial in relation to the diameter of the ring 61 and allows the ring 61 to be driven by means of the drive member (tooth) 4. The second flank 6101 is inclined and forms an angle of less than 30° with the tangent to the ring 61 so that when the tooth 4 is in contact with the second flank 6101, it can slide along this second flank 6101 without driving same, and without driving the ring 61 either.

The drive ring 61 further comprises an external toothing 611 exhibiting teeth 6110 the tips of which are concentric with the drive ring 61, the hollow 6111 between each of the teeth 6110 being designed to accept the end 620 of a positioning jumper 62. The jumper 62 thus collaborates with the external toothing 611 in order to center the hour indications 6 in a window (not depicted). The end 620 of this jumper 62 opposes the movement of the ring 61 by engaging in the hollow 6111 between the teeth 6110 of the external toothing of the drive ring 61. The stiffness of the jumper 62 is chosen such that it holds the hours drive ring 61 in place when said ring is not being driven by the tooth 4 and so as to allow the end of the jumper 620 to disengage from the hollow 6111 of the external toothing of the hours ring 611 under the action of the tooth 4 on the toothing 6100 and by virtue of a rack spring 33.

The operation of the correction mechanism during corrections in the clockwise direction, namely in order to move the indicated time forward, between minutes 0 and 60, will now be described with the aid of FIGS. 4 to 13. For the sake of clarity, the correction mechanism 1 is not depicted in FIGS. 4 to 13, where only a portion of the time-setting stem 10 is visible. The reference numerals corresponding to the correction mechanism can be seen in FIG. 1.

When the time-setting stem 10, pulled axially into the correction position "P1", turns in a first direction in order to move the displayed minute forwards, it drives the snail cam 5 in the counterclockwise direction, thus causing the first (feeler) end 31 of the rack 3, the second end of the rack 32, the retrograde indicator 2 and the tooth 4 to rotate in the clockwise direction with respect to the pivot point 34. Friction on the drive wheel 7 (FIG. 1) that drives the snail cam 5 prevents this correction from being transmitted to the geartrain of the basic movement, as that would jam the latter.

Figure 4:
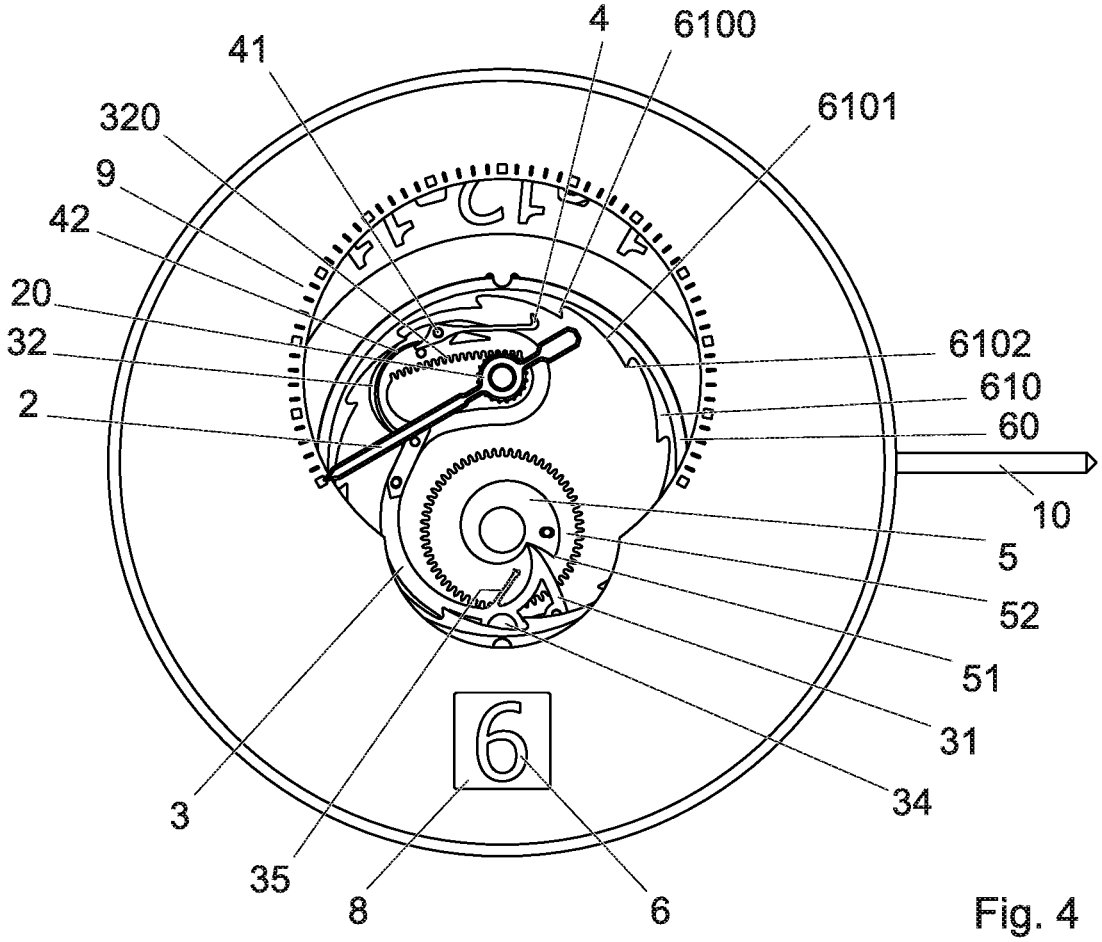
FIG. 4 illustrates a view from above of the movement according to the invention at minute 0.

FIG. 4 illustrates the watch movement at minute 0. In this position, the first end of the rack 31 is resting against the smallest diameter of the snail cam 5. The retrograde mobile 20 is engaged in the teeth at the end of the internal toothing 320 in the opening of the rack 32. In the example illustrated, the tooth 4 is not in contact with the internal toothing 610 of the hours ring 60. The end 35 of the rack 3 stop is not in contact with the snail cam 5 or could slide against the periphery of this snail cam.

Figure 5:
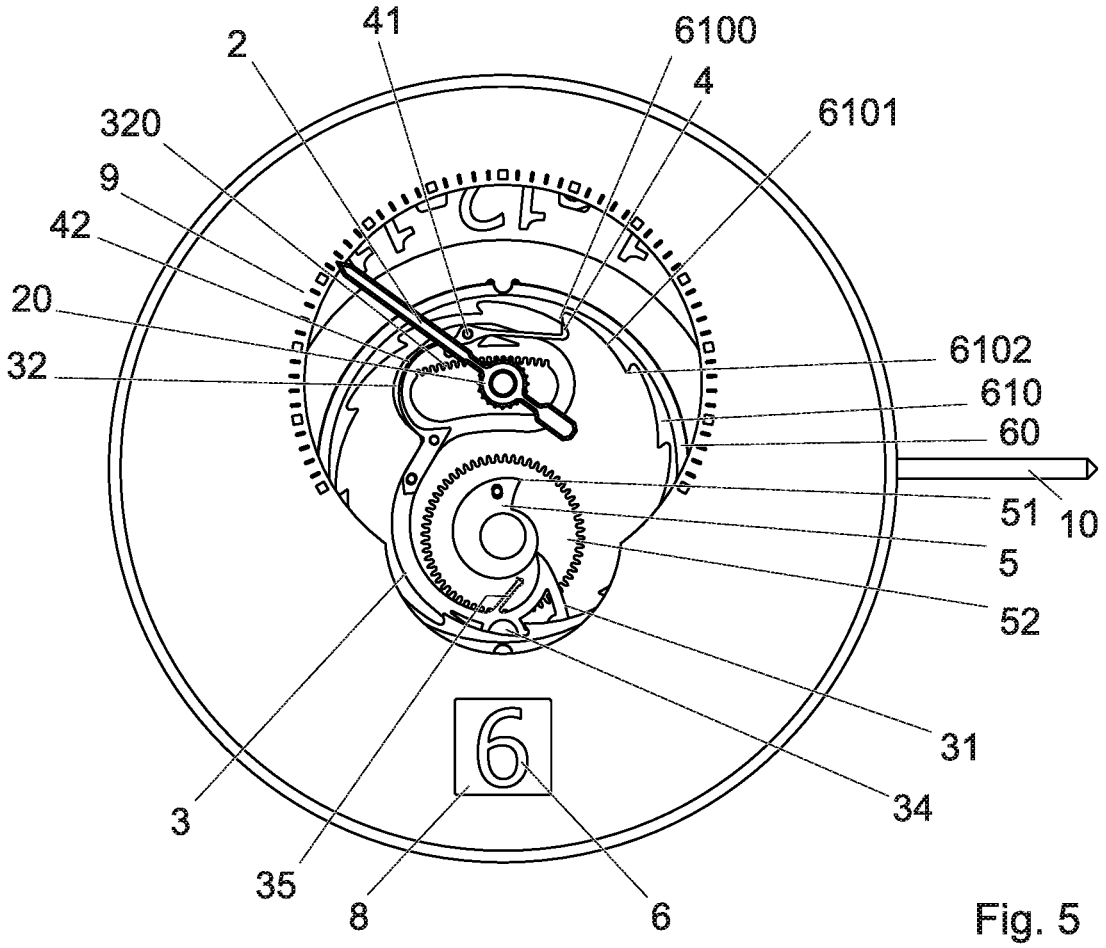
FIG. 5 illustrates a view from above of the device according to the invention at minute 17.

FIG. 5 corresponds to a position of the minute hand 2 at minute 17. The snail cam 5, driven in the counterclockwise direction by the action of the time-setting stem on the wheel 17 (FIG. 1), causes the second end of the rack 32 to move in the clockwise direction to move the minute hand 2 in the clockwise direction along the minute scale 9. The drive member 4 (tooth) brushes against the tip of a tooth of the internal toothing 610 of the ring 61 without having engaged with it. The ring therefore remains immobile, its position being fixed by the jumper 62 which is collaborating with the recesses 6111 on the external periphery of the ring 61 (FIG. 1).

Figure 6:
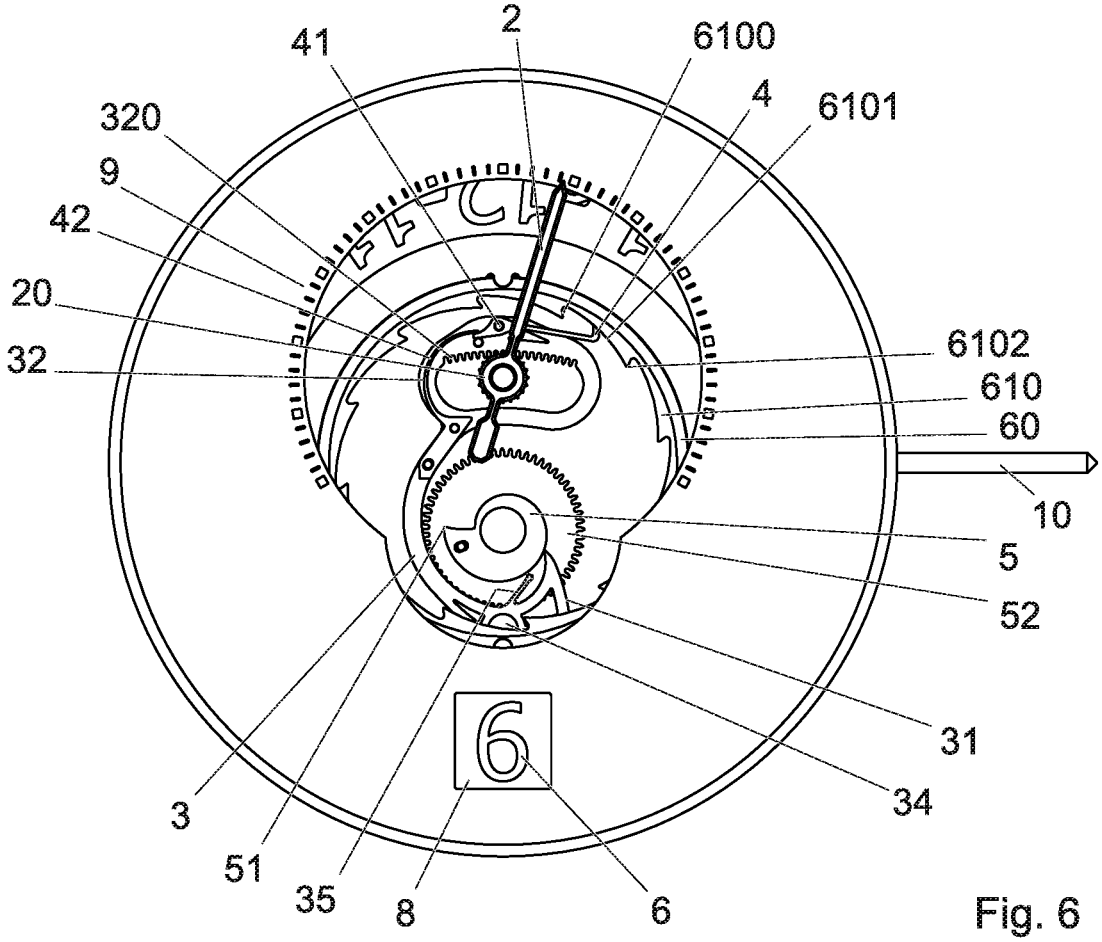
FIG. 6 illustrates a view from above of the device according to the invention at minute 35 (contact of the finger with the toothing 6101).

FIG. 6 corresponds to a position of the minute hand 2 at minute 35, the finger 4 being in contact with the toothing 6101. The retrograde mobile 20 continues to turn in the clockwise direction and the minute hand 2 to move in the clockwise direction along the minute scale 9. The drive member 4 (tooth) comes into contact with an oblique flank 6101 of the internal toothing 610 of the ring 61 without having engaged with it. The ring 61 therefore remains immobile.

During the course of the interval illustrated in FIGS. 4 to 6, which corresponds for example to an interval from 0 to 59 minutes, the tooth 4 slides along the toothing of the hours drive ring, without interfering with the position thereof. The minutes can be corrected in both directions by turning the time-setting stem in one direction or the other. Within this range, correcting the minutes causes no movement of the jumping hours ring.

Figure 7A:
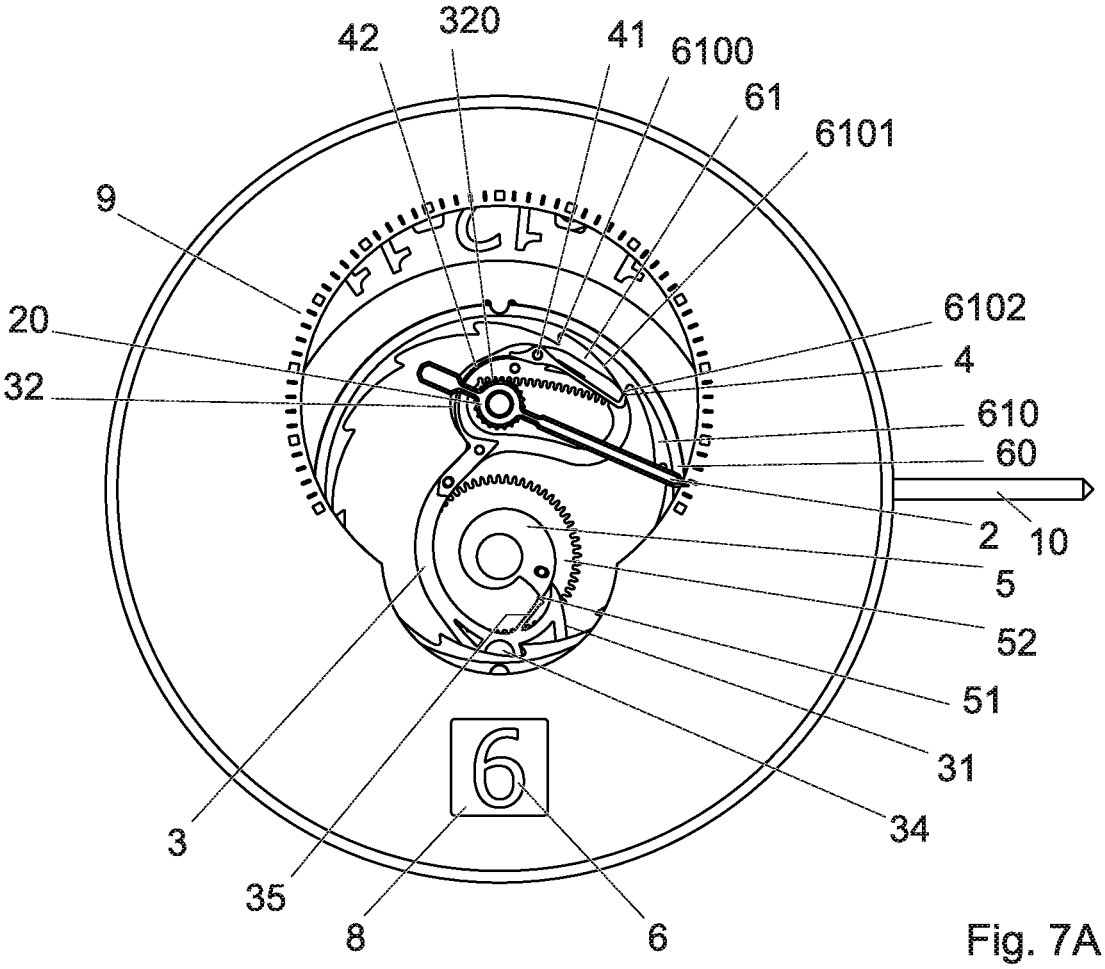
FIG. 7A illustrates a view from above of the device according to the invention at minute 59 (finger 4 catching on the toothing 6100).

FIG. 7A corresponds to a position of the minute hand 2 in a range in which rotation is blocked near to minute 59, for example from minute 57. In this position, the finger 4 has not yet caught on the toothing 610. The first end of the rack 31 is in contact with the snail cam 5 near to the maximum-diameter portion 51 thereof. The drive member 4 (tooth) comes into contact with a tip of the internal toothing 610. Once the finger 4 engages with the toothing 6100, it can drive the ring 61 in the counterclockwise direction in order to cause a jump of the jumping hours if the snail cam 5 continues its rotation in the counterclockwise direction.

Because the movements of the rack 3 in the counterclockwise direction have now to be transmitted to the hour ring 60, it is important to ensure that the minutes are not manually corrected backwards, as this would cause the rings 60 and 61 to move. It would then be possible to leave the hours disk 60 between two figures depending on the minute at which the correction was stopped.

Figure 7B:
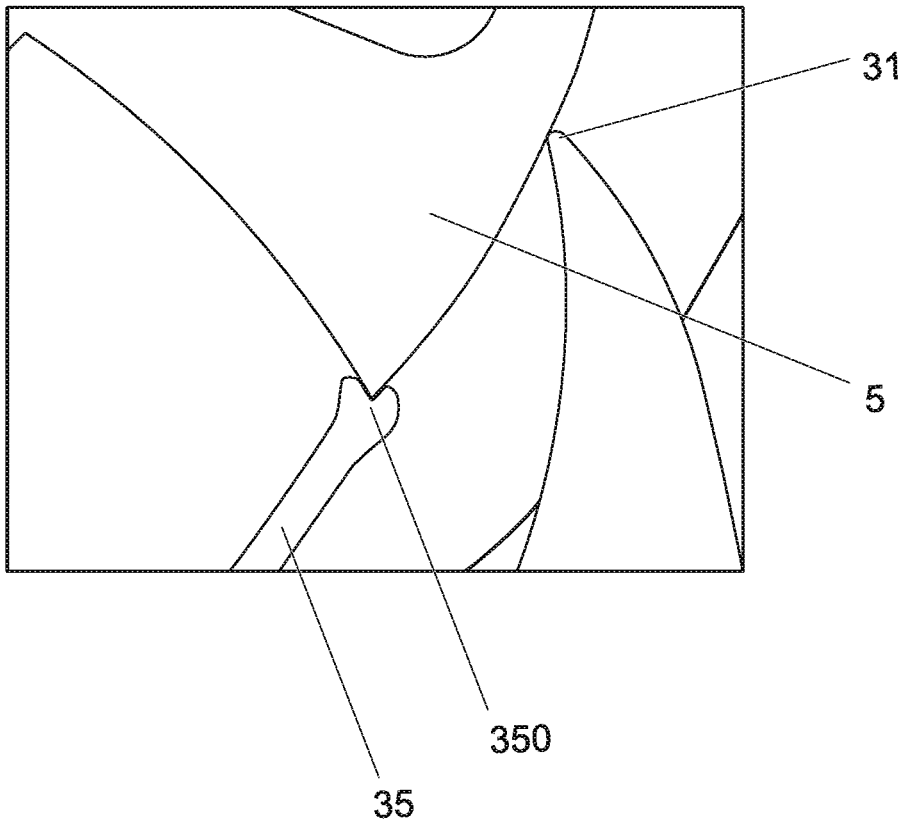
FIG. 7B illustrates a detail of FIG. 7A, in particular showing the end of the rack end stop which presses against the edge of the jump of the snail cam.

In order to avoid this risk, as can be seen in particular in FIG. 7B, the end 350 of the rack stop 35 rests against the edge of the fall on the periphery of the snail cam 5 and thus prevents it from rotating in the clockwise direction. The rack stop 35 thus acts as a mechanism that blocks the rotation of the cam, so as to prevent the cam 5 from rotating in the clockwise direction and from driving the rack in the counterclockwise direction, thus unintentionally moving the ring 61 already caught.

The rack stop 35 acts only in a limited range when the feeler 31 is just before the fall of the cam; it remains possible to rotate the cam 5 in both directions outside of this range. In one embodiment, the rotation of the snail cam 5 is blocked in the clockwise direction when the minutes indicator is between 57 and 59 minutes.

Figure 8:
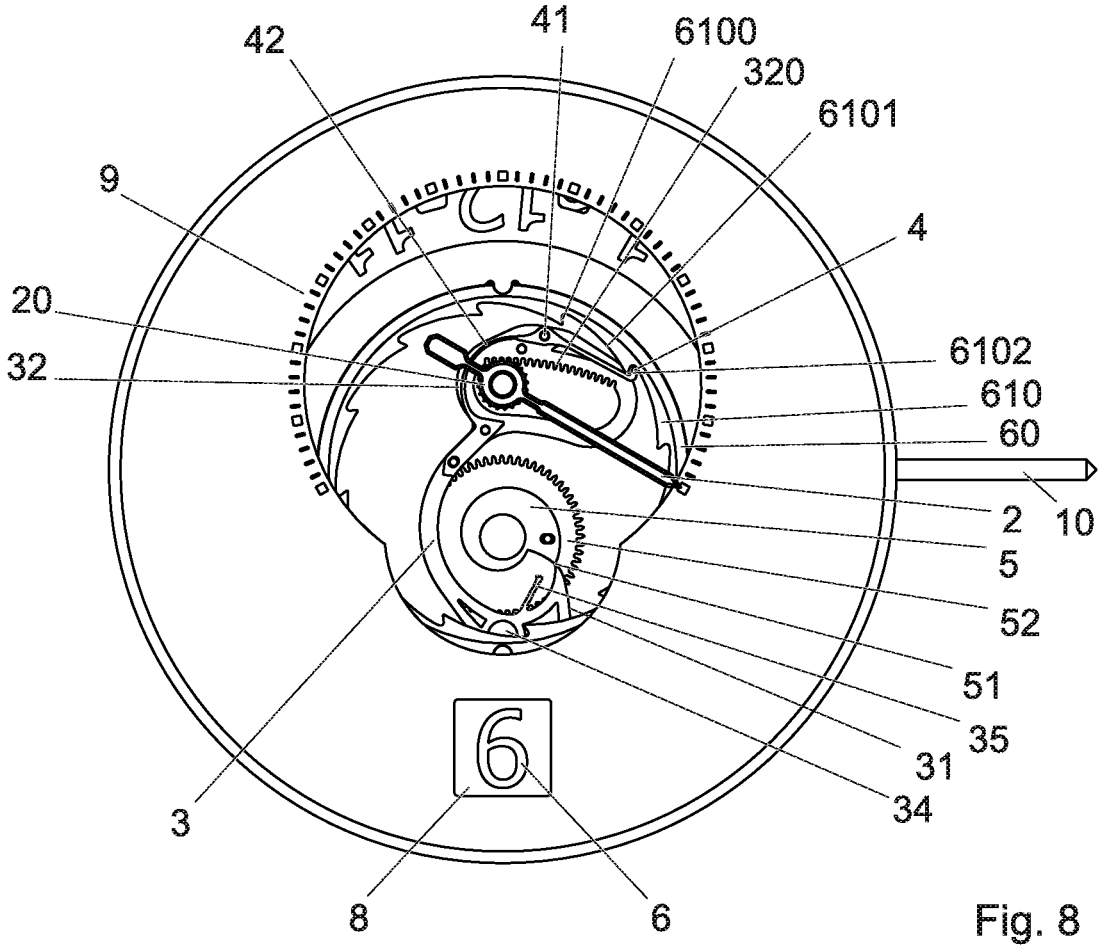
FIG. 8 illustrates a view from above of the device according to the invention at minute 60.

FIG. 8 corresponds to a position of the minute hand 2 at minute 60. The first end of the rack 31 is situated at the peak of the snail cam 5. The drive member 4 (tooth) has moved beyond the tip of the internal toothing 610 and has engaged with a first flank 6100 of the internal toothing 610 of the ring 61. The ring is still held in place by the return jumper 62 (FIG. 1).

At minute 60, the falling of the rack 3 onto the snail cam 5 simultaneously causes a near-instantaneous return of the minutes indicator 2 to 0 in the counterclockwise direction and a jump of the hours ring 61, likewise in the counterclockwise direction, so as to display the next hour. This return is illustrated in FIGS. 8 to 13.

Figure 9:
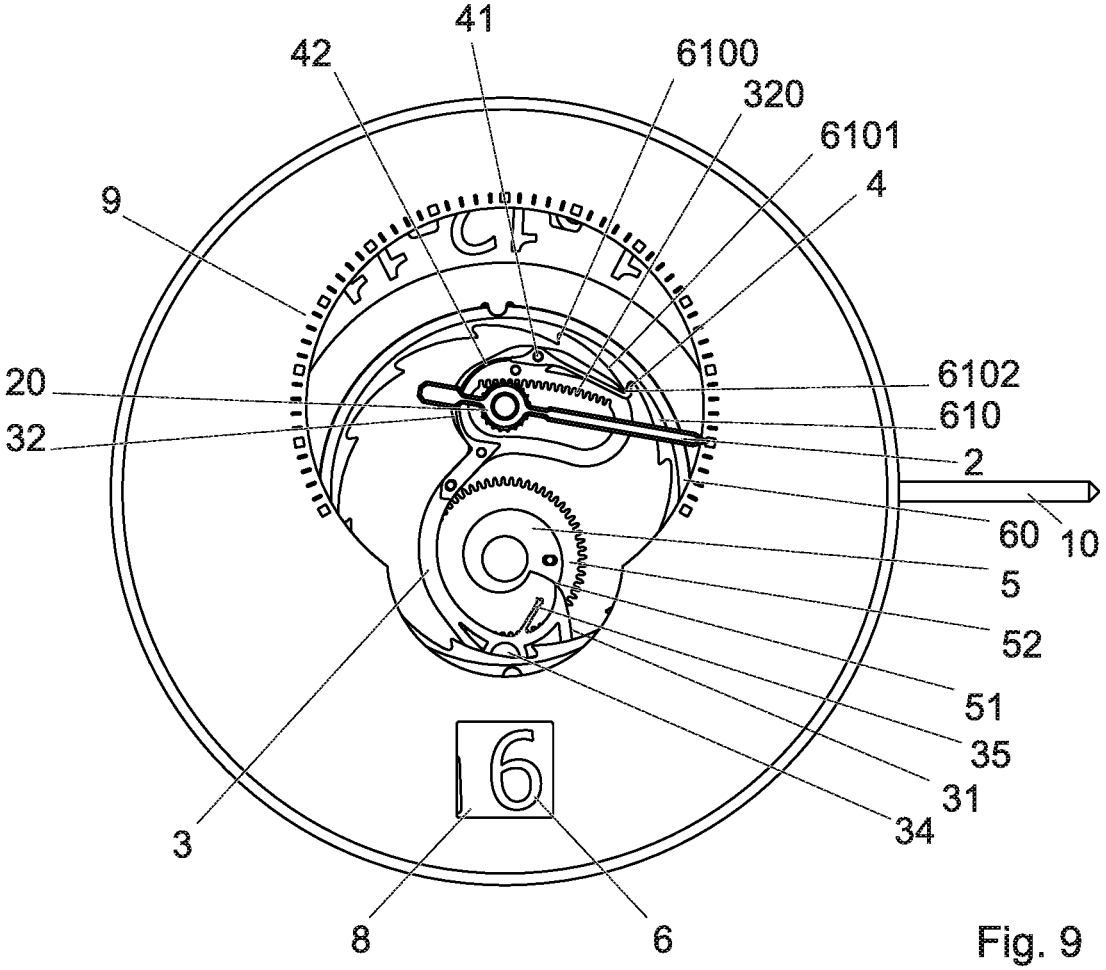
FIGS. 9 to 13 illustrate a number of views from above of the device according to the invention during the jump from minute 60 to minute 0.

FIGS. 8 and 9 illustrate the start of the return to minute 0 of the retrograde indicator 2 and the start of the jump of the jumping display. The first end of the rack 31 begins its fall from the peak of the snail cam 5. The second end 32 of the rack rotates in the counterclockwise direction causing the retrograde indicator 2 positioned at minute 55 and the tooth 4 to rotate in the same direction. The hours ring 60 is therefore driven in the counterclockwise direction by the tooth 4, by virtue of the rack spring 33 (FIG. 1) which progressively relaxes. As it relaxes, the rack spring 33 (FIG. 1) transmits to the ring 60 enough energy to cause the end 620 (FIG. 1) of the positioning jumper 62 (FIG. 1) of the ring 61 to leave the recess 6111 (FIG. 1) of the external toothing 611 (FIG. 1). The movement of the hours disk 60 in the counterclockwise direction, causing the time to move on from h to h+1, can be seen through the window 8.

Figure 10:
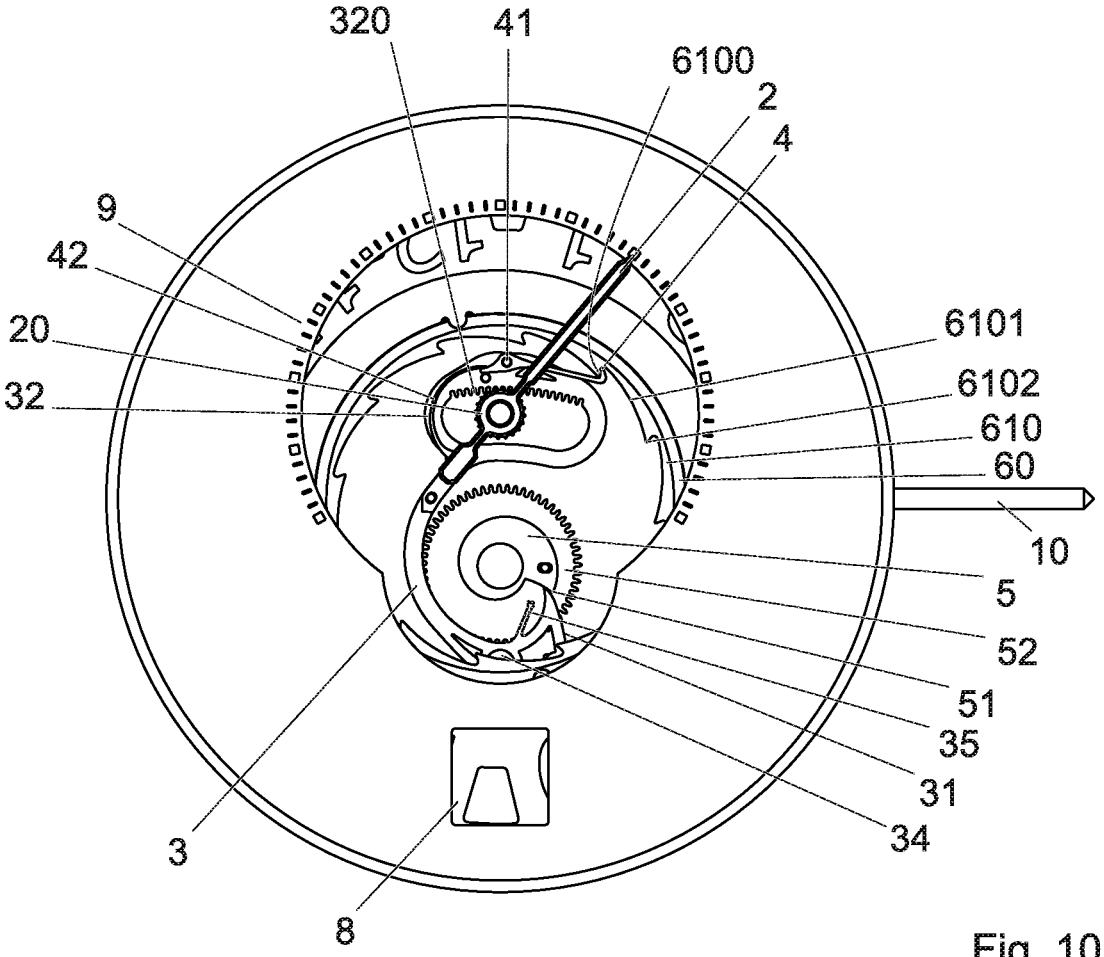
Figure 11:
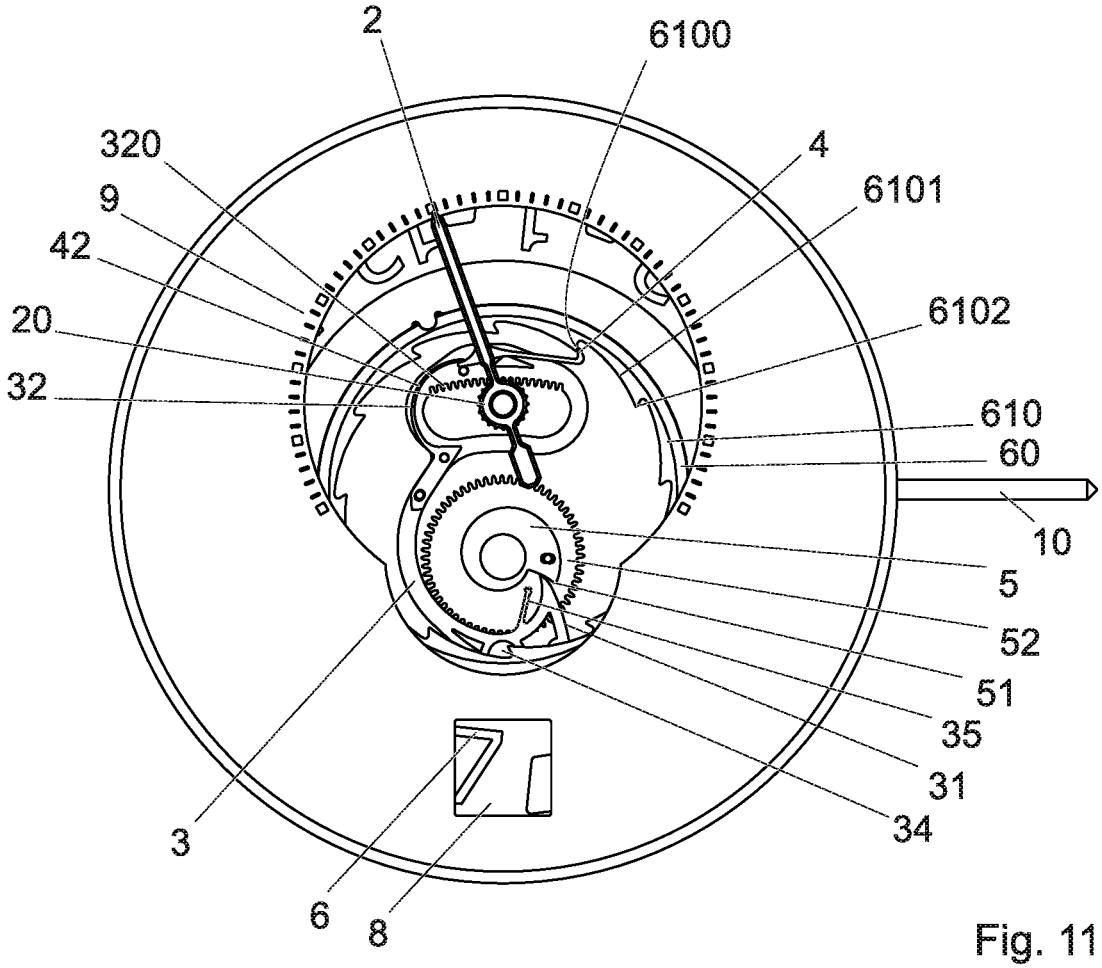

FIGS. 10 and 11 illustrate the next part of the return of the retrograde indicator 2. The retrograde indicator 2 is positioned at minutes 40 and 25 respectively. The tooth 4 moves along the first flank of the internal toothing 610. The movement of the hours disk 60 in the counterclockwise direction, into a position between two jumping display elements 6, can be seen through the window 8. The end 620 (FIG. 1) of the jumper 62 (FIG. 1) moves along the tooth 6110 (FIG. 1).

Figure 12:
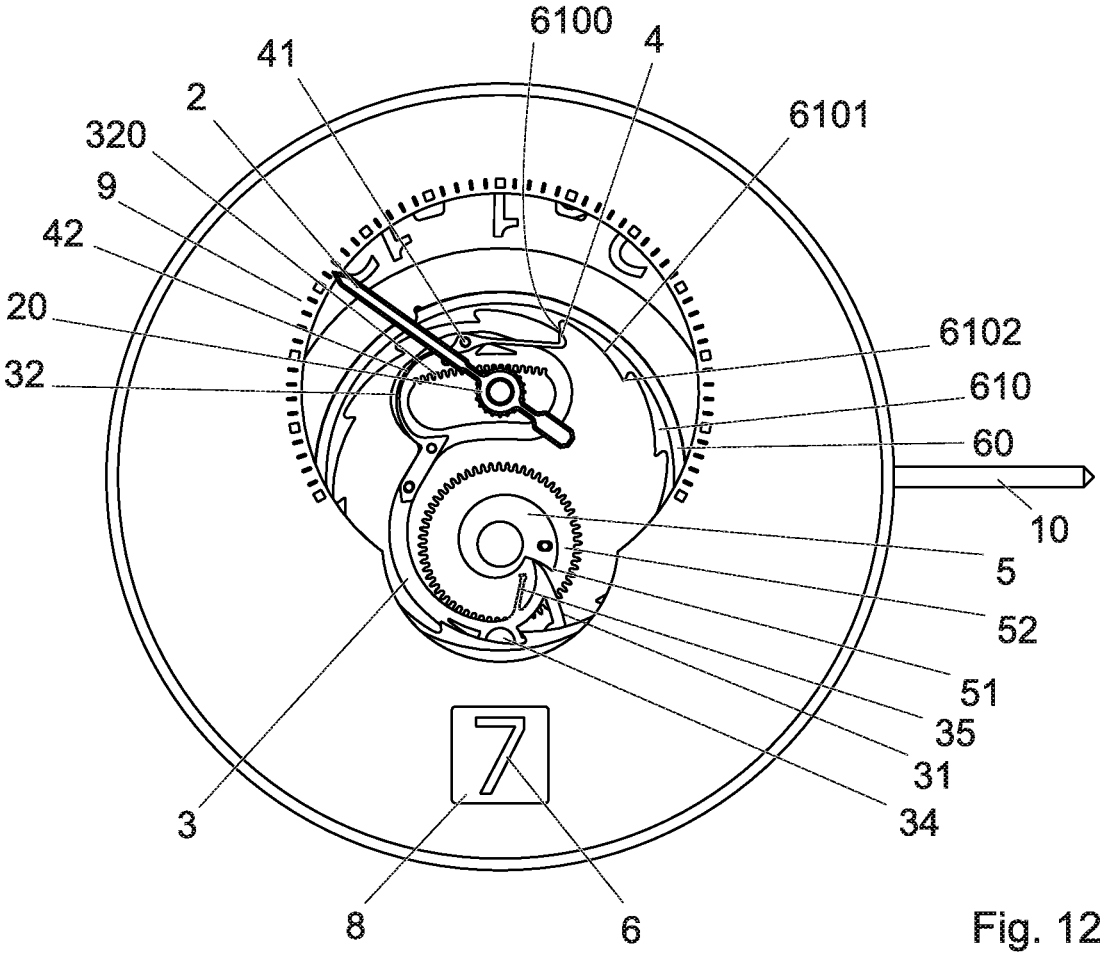

FIG. 12 illustrates the end of the return of the retrograde indicator 2. The retrograde indicator 2 is positioned at minute 17 and the tooth 4 is almost at the tip of the internal toothing of the hours ring 610, and will soon no longer be engaged with the internal toothing 610. The new jumping display element 6 can be seen through the window 8. The jumper 62 (FIG. 1) has "dropped back" into a recess 6111 (FIG. 1) of the external toothing 611 (FIG. 1).

Figure 13:
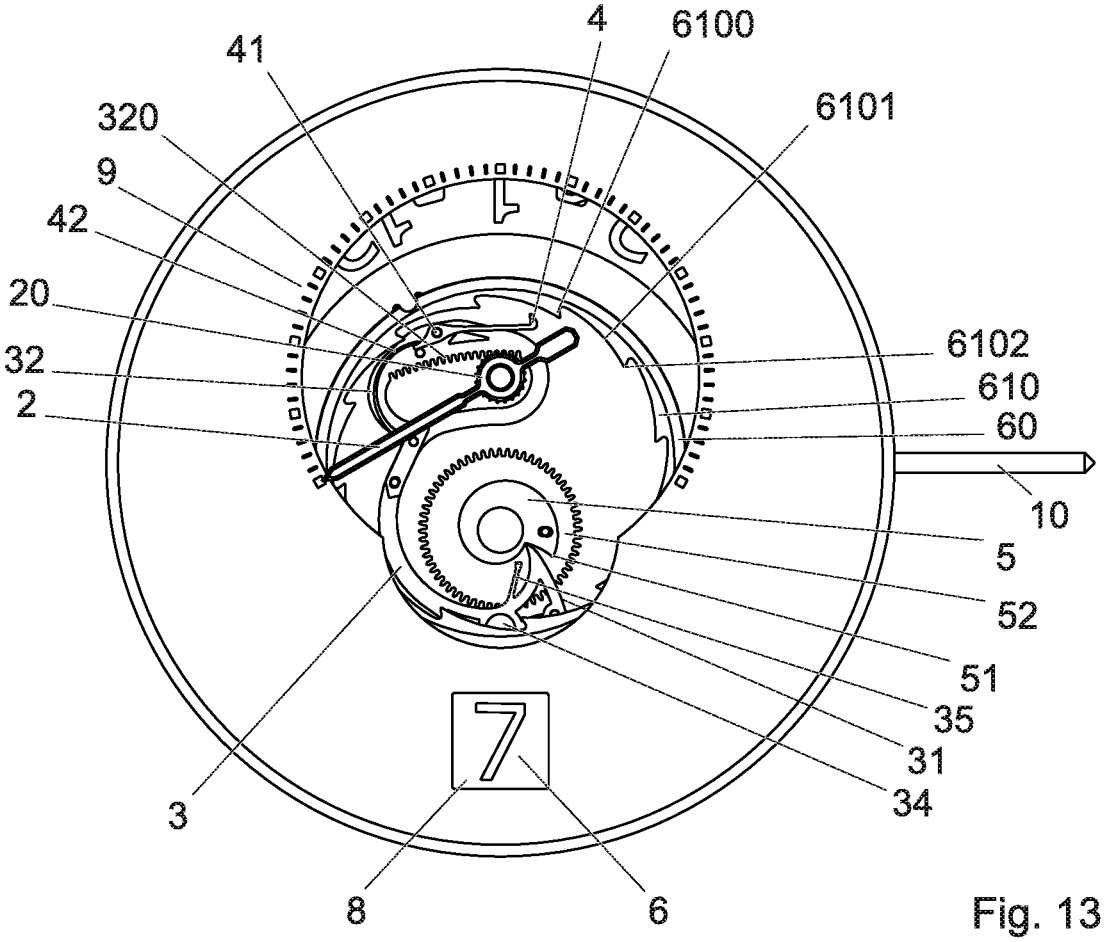

FIG. 13 illustrates the return of the retrograde indicator 2 to minute 0. The retrograde indicator 2 is positioned at minute 0 and the tooth 4 is no longer in contact with the internal toothing of the hours ring 610. The first end of the rack lies on the smallest-diameter part of the snail cam 5. The new position of the jumping display element 6 can be seen through the window 8.

The correction mechanism 1 thus allows jumping correction of the hours display in the clockwise direction. This correction is achieved through the intermediary of the minutes correction mechanism 1, by turning the time-setting stem 10 into the correction position "P1". A correction of unlimited amplitude can thus be performed in the clockwise direction.

The operation of the correction mechanism in the counterclockwise direction between minutes 0 and 59, namely by turning the time-setting stem in a second direction in order to "turn back time", will now be described. Rotating the time-setting stem in the second direction causes the snail cam 5 to rotate in the clockwise direction, and causes the rack 3, the retrograde minutes indicator 2 and the drive member 4 to rotate in a counterclockwise direction. In this direction, the correction movements of the windings stem are transmitted to the snail cam 5 and to the rack 3. Between minutes 0 and 59, the drive member 4 driven in the counterclockwise direction slides against the second flank 6101 of the drive ring 61, without moving same.

From minute 57 onwards, or as soon as the snail cam enters the rotation-blocking range, the rack stop 35 presses against the edge of the fall of the snail cam 5 and prevents the latter from continuing its rotation in the clockwise direction, as explained above. If the user forces the issue, the friction wheel 17 (FIG. 1) slips and the movements of the time-setting stem remain ineffectual.

After the fall, namely at minute 0, rotation of the snail cam 5 in the clockwise direction is blocked by the rack 3 which cannot climb back up the fall of this snail cam 5. The friction wheel 17 slips and the movements of the time-setting stem remain ineffectual.

It is therefore not possible to move on directly from minute 01 to minute 59; the friction wheel 17 prevents this movement. However, the user can correct the time using a suitable number of rotations in the clockwise direction.

In the clockwise direction, this correction device thus allows an unlimited correction to be made to the hours and to the minutes with, between the end of minute 60 and minute 0, a near-instantaneous return of the minute hand 2 and a synchronized jump of the hours indicator 6.

In the counterclockwise direction (in order to turn back time), this correction device thus allows the minutes to be corrected only outside of the blockage range, for example between minute 57 (or 59) and minute 0.

Figure 14:
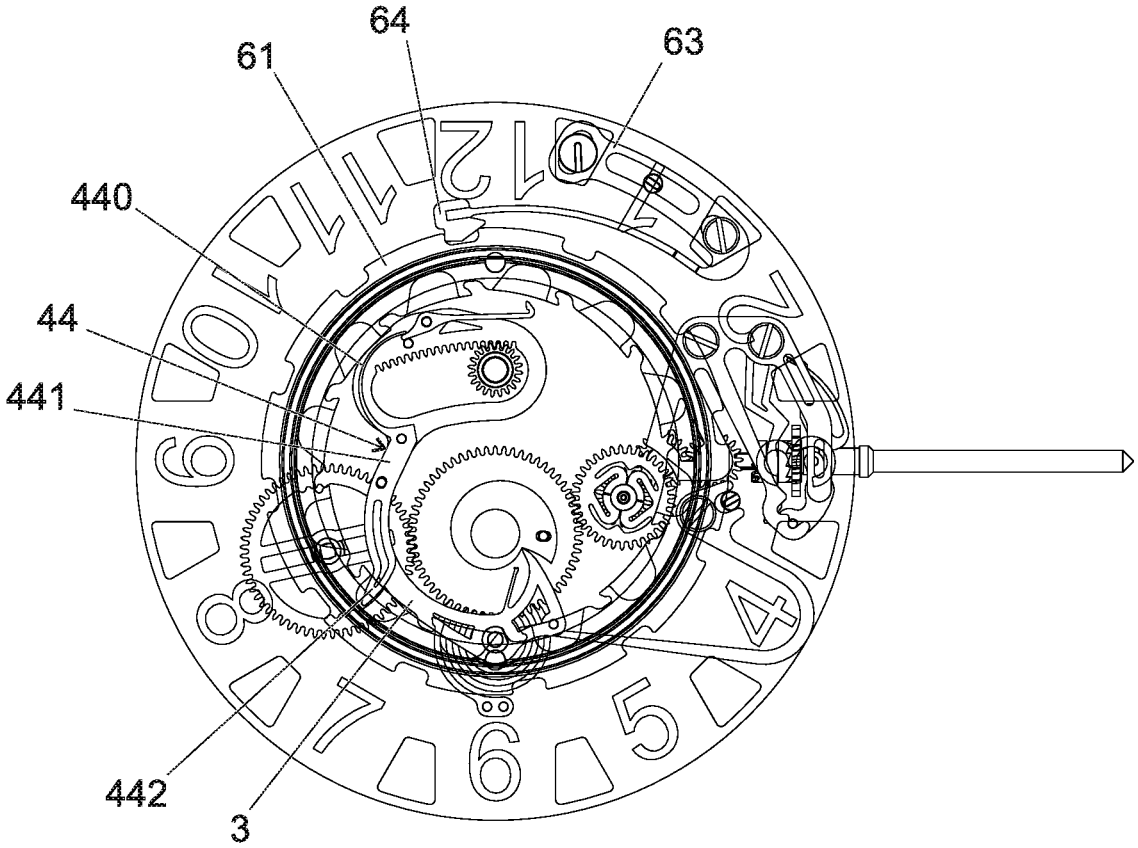
FIG. 14 illustrates a view from above of the key components of the watch movement correction mechanism according to the second embodiment of the invention.

FIG. 14 illustrates a view from above of the key components of the watch movement correction mechanism according to a second embodiment of the invention. This alternative form chiefly exhibits two differences in relation to FIG. 1:

- it has a return spring 44 of a different shape from the return spring 42 of FIG. 1, and
- it has a jumper 64 of a different shape from the jumper 62 of FIG. 1.

As will be discussed later on, the return spring 44 and the jumper 64 which are illustrated in FIG. 14 make it possible to perform two separate functions, which collaborate with one another. In particular, the return spring 44 makes it possible to control the position of the ring 61 as it rotates in the counterclockwise direction, by virtue of its collaboration with the internal toothing of the ring 61; the jumper 64 for its part makes it possible to prevent the ring 61 from being able to turn in the clockwise direction as a result of the ring 61 bouncing off the return spring 44 via a tooth of the internal toothing of the ring 61, as this would cause a display error.

It is important to emphasize at this point that it is not essential to have the return spring 44 and the jumper 64 both present at the same time. It is possible for example to envision a mechanism comprising the return spring 44 of FIG. 14, and the jumper 62 of FIG. 1. However, this mechanism could suffer from display problems, which are solved by the jumper 64 of FIG. 14.

The return spring 44 of the alternative form of FIG. 14 exhibits:

- a C-shaped first end 440, substantially identical in shape to that of the first end 420 of the return spring 42 of FIG. 1,
- a body 441, which is substantially identical to the body 421 of the return spring 42 of FIG. 1, and
- a second end 442, which is absent in the return spring 42 of FIG. 1. This second end 442 forms a tooth which collaborates with the internal toothing of the ring 61.

Figure 15A:
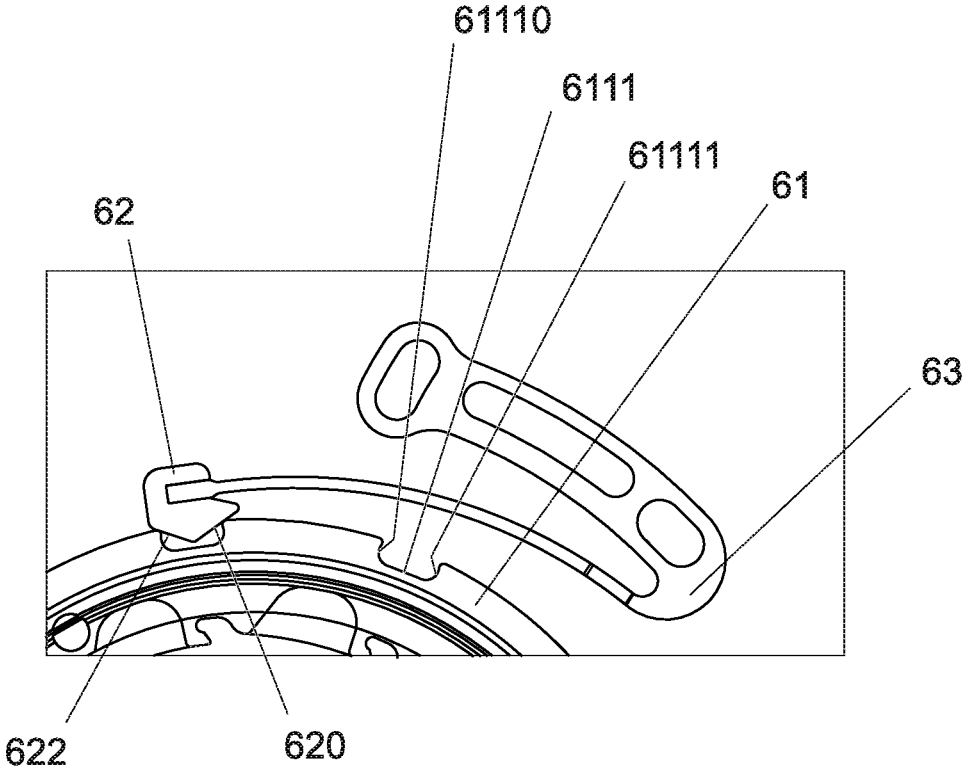
FIG. 15A illustrates a view from above of a simplified part of the watch movement correction mechanism according to the first embodiment of the invention.

In order to demonstrate the difference in shape between the jumper 62 of FIG. 1 and the jumper 64 of FIG. 14, the jumper 62 is now described in greater detail with reference to FIG. 15A. The jumper 62 has a first end (or output end) 620 and a second end (or input end) 622. The two ends exhibit a non-zero inclination with respect to the edge corners 61110 and 61111 that define the vertical walls of the recess 6111 of the external toothing 611 of the drive ring 61. The jumper 62 collaborates with a jumper spring 63.

Figure 15B:
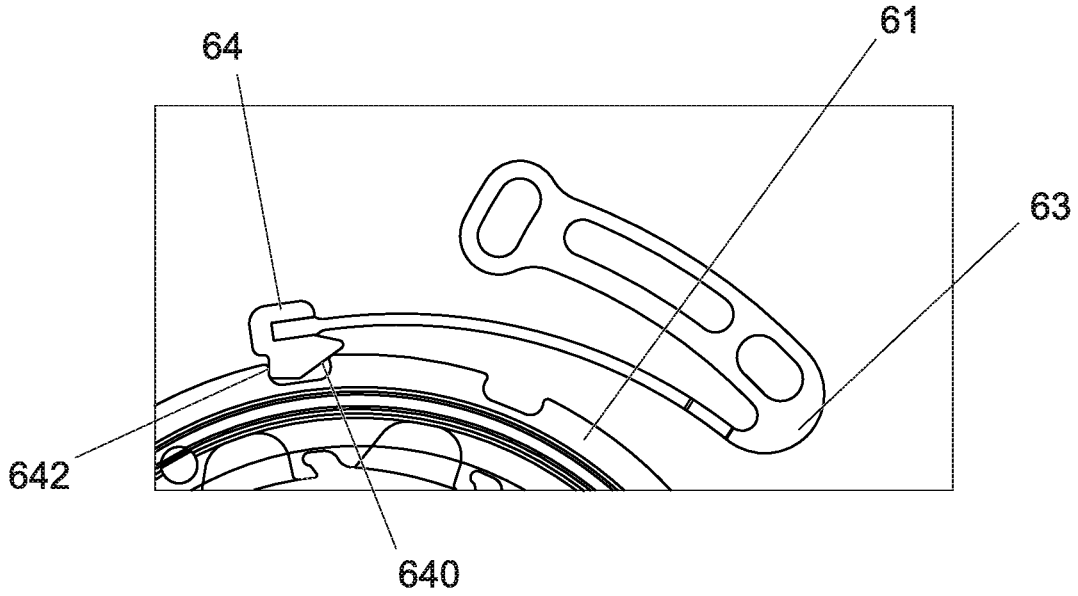
FIG. 15B illustrates a view from above of a simplified part of the watch movement correction mechanism according to a second embodiment of the invention.

FIG. 15B illustrates the new shape of the jumper 64, in detail. It has a first end (or output end) 640 and a second end (or input end) 642. Only the first end 640 exhibits a non-zero inclination with respect to the edge corners 61111 and 61110 that define the recesses 6111 of the external toothing of the drive ring 61. The second end 642 is in fact substantially parallel to the edge corners 61111 and 61110 when the jumper 64 is engaged in the recess 6111. This particular shape of the jumper 64 allows clockwise rotation of the drive ring 61 to be blocked. In other words, the second end 642 of the jumper 64 is configured in such a way as to block clockwise rotation of the drive ring 61.

Figure 16:
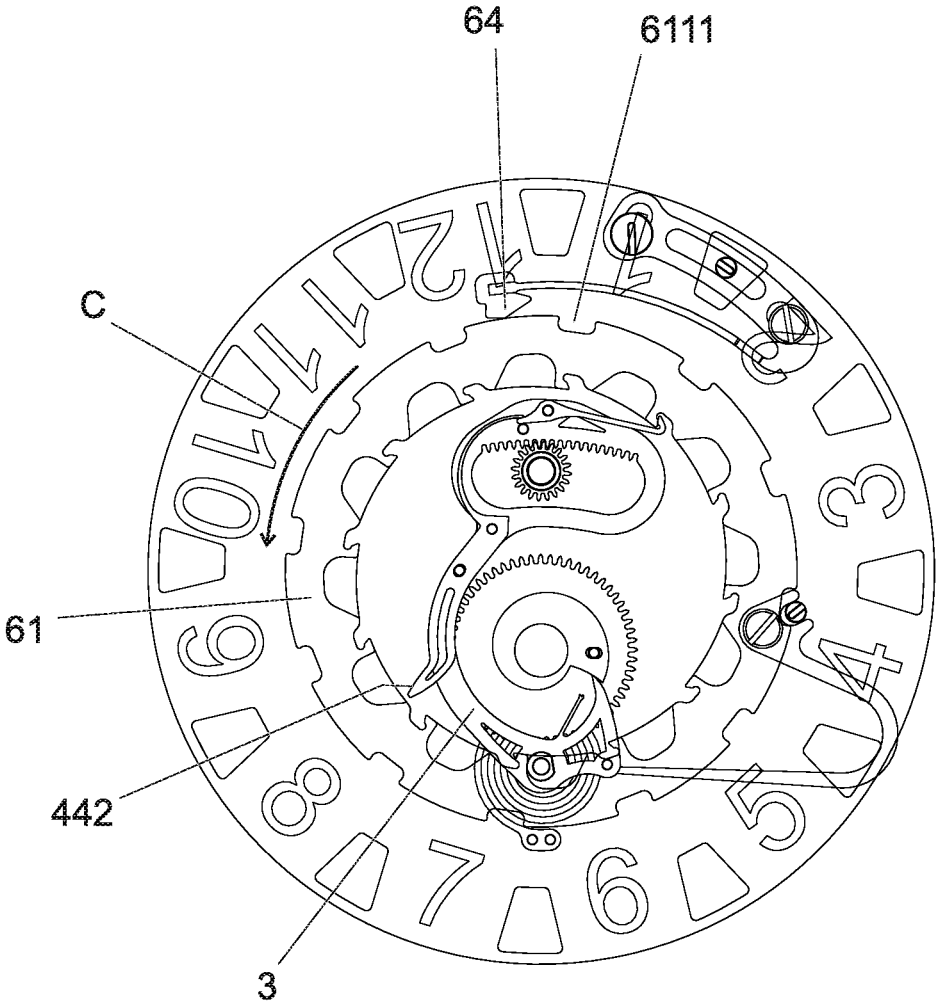
FIGS. 16 to 20 illustrate a number of views from above of the device according to the second embodiment of the invention.

FIGS. 16 to 20 illustrate a number of views from above of the device according to the second embodiment of the invention. FIG. 16 illustrates the ring 61 which is in the process of turning in the counterclockwise direction as indicated by the arrow C, driven by the rack 3. The end 442 of the spring 44 is not in contact with the internal toothing of the ring 61. The jumper 64 slides along the part between two consecutive recesses 6111 of the external toothing of the ring 61. The end 442 of the spring 44 is not yet in contact with the internal toothing of the ring 61.

Figure 17:
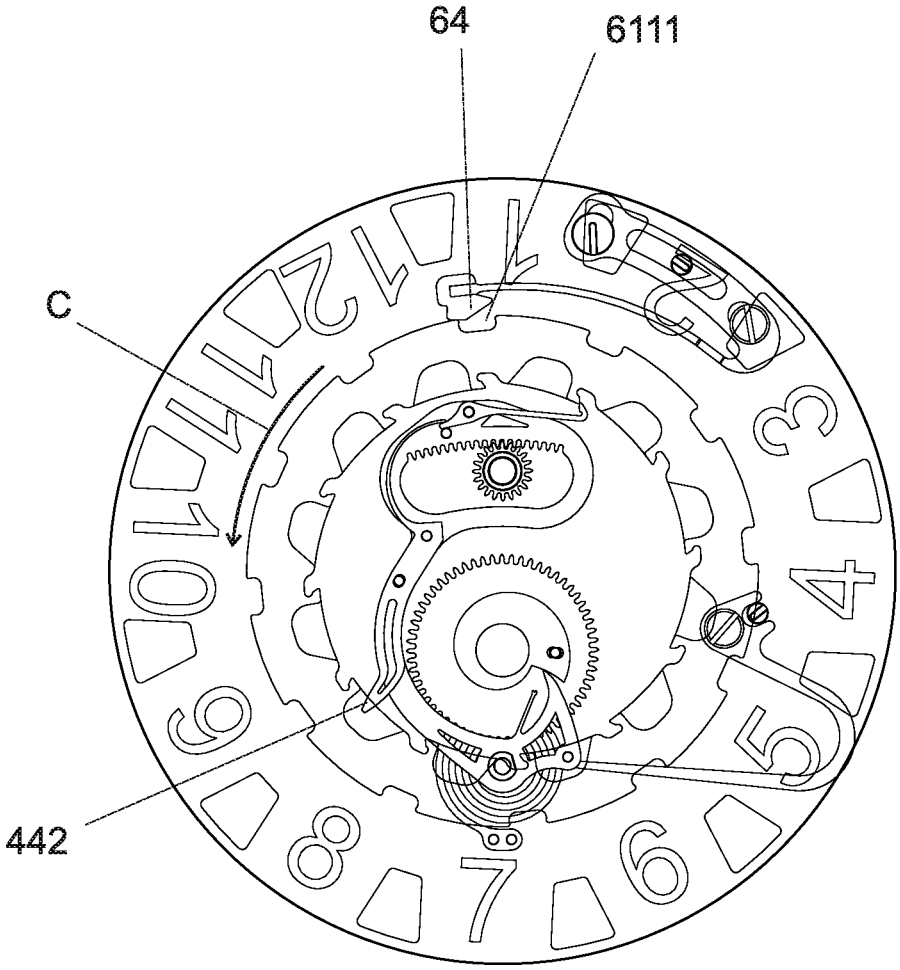

FIG. 17 illustrates the ring 61 which continues to rotate in the counterclockwise direction (arrow C): the jumper approaches the recess 6111. The end 442 of the spring 44 approaches the internal toothing of the ring 61.

Figure 18:
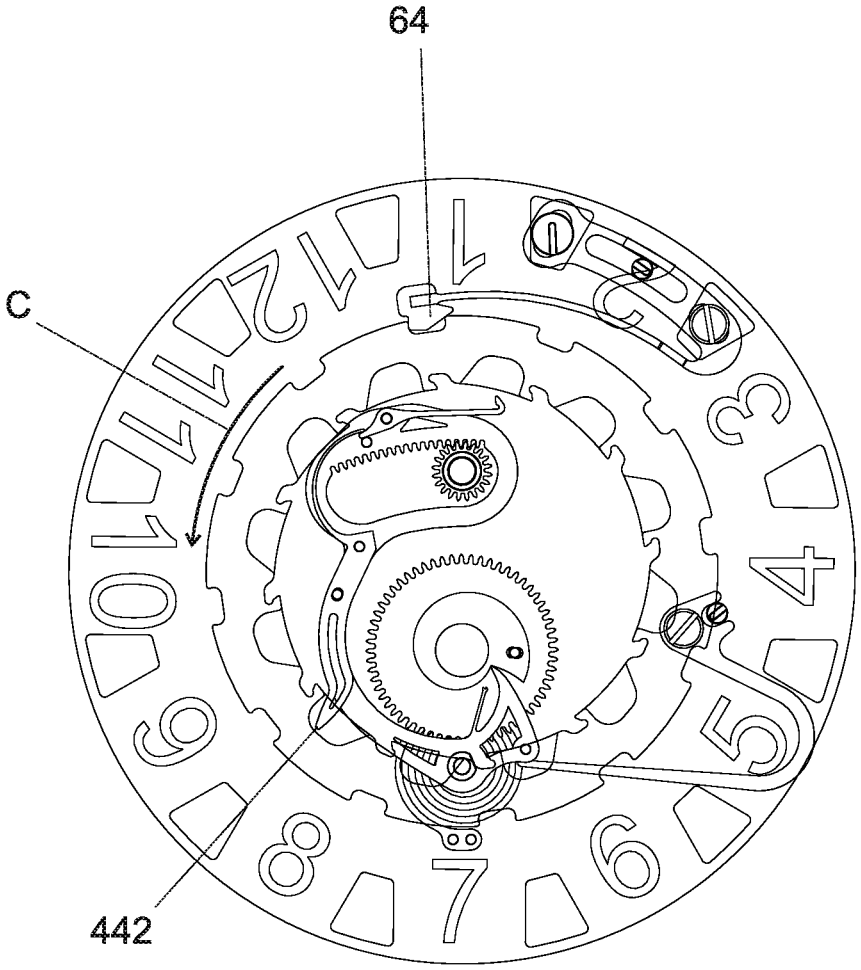

FIG. 18 illustrates the ring 61 which continues to rotate and completes its rotation in the counterclockwise direction (arrow C): the jumper enters the recess (reference 6111 in FIG. 17). The end 442 of the spring 44 moves even closer to the internal toothing of the ring 61, touching same.

Figure 19:
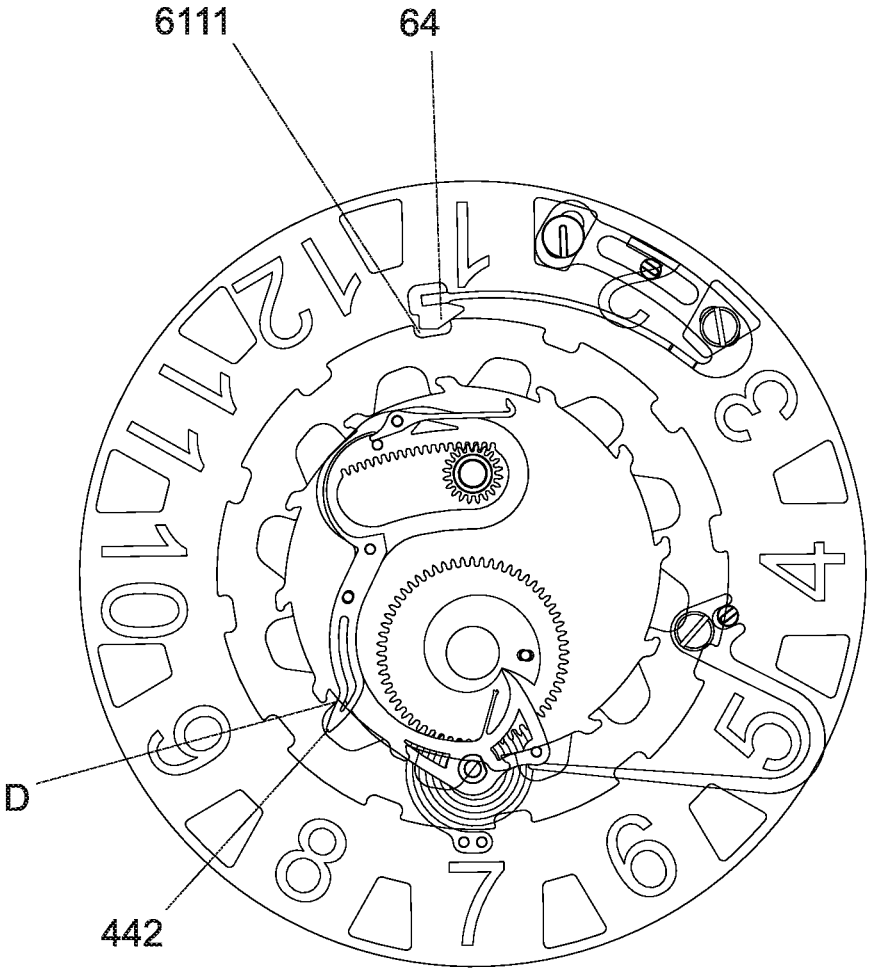

FIG. 19 illustrates the ring 61 rebounding off the spring 44: notably a tooth of the internal toothing of the ring 61 comes into contact with the end 442 of the spring 44 in register with the point (or zone) of contact D. In an alternative form, the ring 61, as a result of this rebound, is made to turn in the opposite direction, namely in the clockwise direction. The rebound is present notably when, for example, the spring 33 (illustrated in FIG. 1 for example) is tensioned to the maximum via its eccentric.

If the jumper 62 of FIG. 1 were used in place of the jumper 64, its end 622 would allow it to come out of the recess 6111, allowing the ring 61 to continue its rotation in the clockwise direction. The jumper 62 would therefore come out of the recess 6111 and would be incapable of bringing the figure into the window, and this would lead to a display problem.

Figure 20:
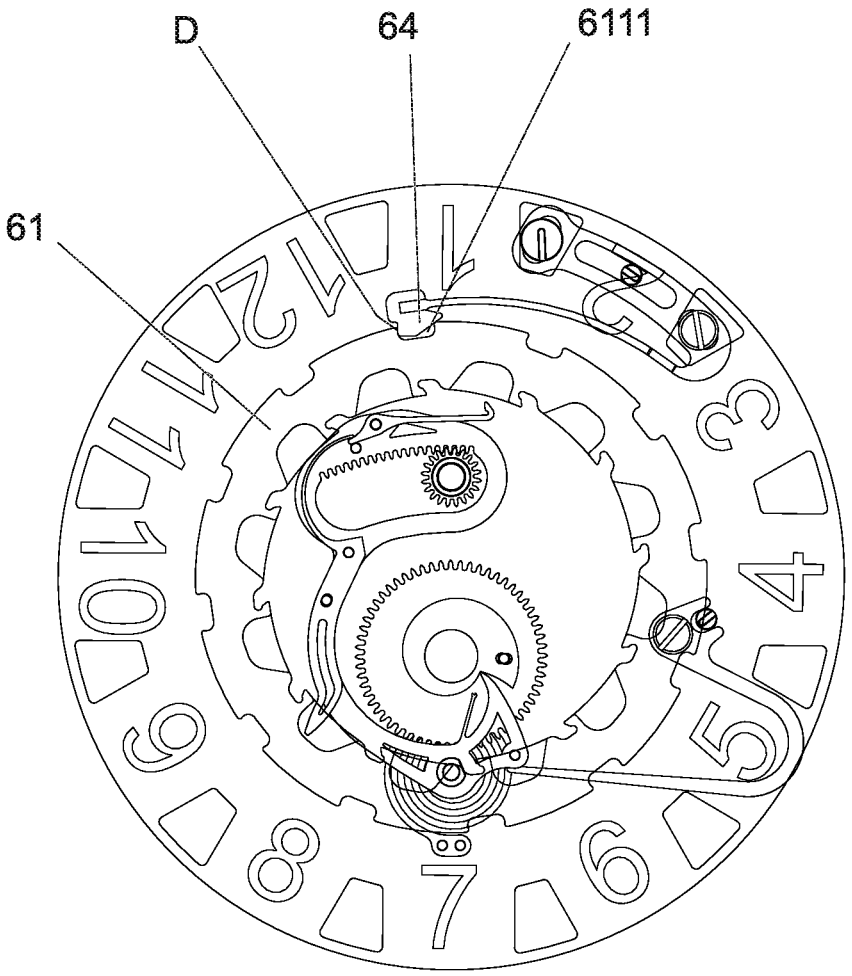

By contrast, the jumper 64 of FIG. 14 has a shape which prevents it from coming out of the recess 6111 after the rebounding of the ring 61, thereby blocking any clockwise rotation of the ring 61 and therefore preventing any display error. Specifically, as can be seen in FIG. 20, the jumper 64 is in abutment in the recess 6111 of the external toothing of the ring, making it possible to block the ring 61 in position with the hours figure in the window (not illustrated).

The alternative form illustrated in FIG. 14 and the operation of which is detailed in FIGS. 16 to 20, therefore allows more precise control over the position of the ring 61 by comparison with the alternative form illustrated in FIG. 1. The return spring 44 allows the ring 61 to make just one jump in the counterclockwise direction. The jumper 64 makes it possible to prevent the ring 61 from being able to turn in the clockwise direction as a result of the ring 61 bouncing off the return spring 44 via a tooth of the internal toothing of the ring 61.

In the alternative form illustrated in FIG. 1, it was necessary to adjust the rack spring 33 and/or the jumper 62 precisely, in order to control the position of the ring 61. In the alternative form illustrated in FIG. 14, such adjustment is greatly simplified, or even non-existent.

REFERENCE NUMERALS USED IN THE FIGURES

1 Watch movement, particularly correction mechanism
10 Time-setting stem
11 Pull-out piece
12 Pull-out piece jumper
120 First depression
121 Second depression
13 Lever
131 Lever spring
14 Rewinding pinion
15 Sliding pinion
16 First correction transfer gear
17 Motion-work drive wheel
18 Second correction transfer gear
2 Retrograde indicator
20 Retrograde mobile
200 Toothing of mobile 20
3 Rack
31 First end of the rack
32 Second end of the rack
320 Toothing of rack 3
33 Rack spring
34 Pivot point
35 Rack stop (correction blocking mechanism)
350 Head of the rack stop
4 Drive member/tooth/finger
41 axis
42 First alternative form of return spring
420 End of return spring 42
421 Body of return spring 42
44 Second alternative form of return spring
440 First end of return spring 44
441 Body of return spring 44
442 Second end of return spring 44
5 Snail cam
51 Peak of snail cam
52 Release drive wheel
6 Jumping display element
60 Jumping display element ring
61 Jumping display element drive ring
610 Internal toothing of drive ring 61
6100 First flank of toothing 610
6101 Second flank of toothing 610
6102 Tip of toothing 610
611 External toothing of drive ring 61
6110 Tooth of toothing 611
6111 Recess of toothing 611
61110 First edge corner of recess 6111
61111 Second edge corner of recess 6111
62 First embodiment of jumper for positioning ring 61
620 First end of jumper 62
622 Second end of jumper 62
63 Jumper spring
64 Second embodiment of jumper for positioning ring 61
640 First end of jumper 64
642 Second end of jumper 64
7 Center wheel friction mobile/retrograde minutes intermediate transfer gear
8 Jumping hours window
9 Minutes scale

The invention claimed is:

1. A watch movement comprising:

a retrograde mobile;

an hours ring bearing an asymmetric internal toothing and driven via the retrograde mobile in order to display the current hour in a jumping way;

a correction mechanism allowing the retrograde mobile to be corrected in a bidirectional way;

a drive member that can be activated by said correction mechanism and engages with said asymmetric internal toothing so that corrections of the retrograde mobile in the clockwise direction are transmitted to the hours ring, and so that corrections in the counterclockwise direction are not transmitted to the hours ring.

2. The movement as claimed in claim 1, in which said asymmetric internal toothing comprises a plurality of teeth with asymmetric flanks, said drive member being arranged in such a way as to be able to butt against one flank of a tooth of the internal toothing and to drive the hours ring when the retrograde mobile is rotating in the counterclockwise direction, and to slide along another flank of a tooth of the internal toothing when the retrograde mobile is rotating in the clockwise direction.

3. The movement as claimed in claim 1, said retrograde mobile allowing the minutes to be displayed.

4. The movement as claimed in claim 3, comprising a snail cam and a rack engaged with the snail cam in order to drive said retrograde mobile.

5. The movement as claimed in claim 4, comprising a spring mounted on said rack and applying a force to press said drive member onto said asymmetric internal toothing.

6. The movement as claimed in claim 5, in which the snail cam rotating in a first direction of rotation drives said rack and said retrograde mobile in the opposite direction of rotation.

7. The watch movement as claimed in claim 4, in which said spring mounted on said rack comprises an end, for example a tooth-shaped end, designed to collaborate with said asymmetric internal toothing so as to control the counterclockwise rotation of the driving ring.

8. The watch movement as claimed in claim 7, comprising a jumper having a shape designed to block any clockwise rotation of the drive ring when said jumper is engaged in a recess of an external toothing of the drive ring.

9. The watch movement as claimed in claim 8, in which said jumper comprises an end substantially parallel to edge corners defining said recess when the jumper engages in said recess.

10. The movement as claimed in claim 3, designed to allow unlimited correction of the hours and minutes display in the clockwise direction.

11. The watch movement as claimed in claim 3, designed to allow correction of the minutes display in the counterclockwise direction.

12. The watch movement as claimed in claim 11, comprising a correction blocking mechanism to prevent the minutes from being corrected in the counterclockwise direction within a range that includes the instant at which the retrograde mobile returns, and to allow the minutes to be corrected in the counterclockwise direction outside of that range.

13. The movement as claimed in claim 1, in which the correction mechanism is designed to allow correction of the hours in the clockwise direction in a jumping way.

14. A method for correcting the display of an item of time-based information on a watch movement as claimed in claim 1, in which, in a first interval:

the rotation of a time-setting stem in a first direction causes a snail cam to rotate in a first direction, and a rack to rotate in a second direction, the rotation of the rack in a second direction causes a retrograde mobile and a drive member to rotate; and said drive member moves along a first flank of an internal toothing of a ring without driving the rotation of said ring, then, at minute 60:

the rotation of the snail cam causes the rack to fall and to rotate in the first direction near-instantaneously;

the near-instantaneous rotation of the rack in the first direction drives the near-instantaneous rotation of the retrograde mobile, the rotation of said drive member pressing against a second flank of the internal toothing of the ring drives this ring with jumping and near-instantaneously.

15. The correction method as claimed in claim 14, wherein:

the rotation of the time-setting stem drives the snail cam;

the rotation of the snail cam causes the rack to rotate in the opposite direction, the rotation of the rack causes the retrograde mobile and the drive member to rotate.

16. The correction method as claimed in claim 15, wherein the correction of the minutes display in the counterclockwise direction is limited to a range that excludes the instant at which the retrograde mobile returns.

* * * * *